US006727776B2

(12) United States Patent
Kanamaluru

(10) Patent No.: US 6,727,776 B2
(45) Date of Patent: Apr. 27, 2004

(54) DEVICE FOR PROPAGATING RADIO FREQUENCY SIGNALS IN PLANAR CIRCUITS

(75) Inventor: Sridhar Kanamaluru, W. Windsor, NJ (US)

(73) Assignee: Sarnoff Corporation, Princeton, NJ (US)

( * ) Notice: Subject to any disclaimer, the term of this patent is extended or adjusted under 35 U.S.C. 154(b) by 75 days.

(21) Appl. No.: 10/071,495

(22) Filed: Feb. 7, 2002

(65) Prior Publication Data

US 2002/0109558 A1 Aug. 15, 2002

Related U.S. Application Data

(60) Provisional application No. 60/267,690, filed on Feb. 9, 2001.

(51) Int. Cl.[7] ..... H01P 1/17
(52) U.S. Cl. ..... 333/21 A; 333/135; 333/137
(58) Field of Search ..... 333/21 A, 125, 333/135, 136, 137

(56) References Cited

U.S. PATENT DOCUMENTS

| | | | | |
|---|---|---|---|---|
| 3,004,228 A | | 10/1961 | Fogel | 333/21 A |
| 3,508,277 A | | 4/1970 | Ware et al. | 343/776 |
| 3,668,567 A | | 6/1972 | Rosen | 333/21 A |
| 3,731,236 A | | 5/1973 | DiTullio et al. | 333/9 |
| 3,922,621 A | | 11/1975 | Gruner | 333/11 |
| 4,410,866 A | | 10/1983 | Bui-Hai | 333/135 |
| 4,491,810 A | | 1/1985 | Saad | 333/126 |
| 4,492,938 A | | 1/1985 | Young | 333/111 |
| 4,498,061 A | | 2/1985 | Morz et al. | 333/21 A |
| 4,498,062 A | | 2/1985 | Massaglia et al. | 333/135 |
| 4,598,262 A | | 7/1986 | Chen | 333/208 |
| 4,922,214 A | | 5/1990 | Kalkert | 333/135 |
| 5,055,805 A | | 10/1991 | Kan | 333/21 A |
| 5,075,649 A | | 12/1991 | Pellegrineschi | 333/137 |
| 5,392,008 A | | 2/1995 | Wong | 333/21 R |
| 5,760,659 A | * | 6/1998 | Harrison et al. | 333/125 |
| 6,031,434 A | | 2/2000 | Tatomir et al. | 333/126 |
| 6,043,789 A | * | 3/2000 | Suzuki et al. | 343/786 |
| 6,087,908 A | | 7/2000 | Haller et al. | 333/122 |
| 6,091,373 A | * | 7/2000 | Raguenet | 343/778 |
| 6,137,450 A | | 10/2000 | Bhattacharyya et al. | 343/786 |
| 6,181,221 B1 | | 1/2001 | Kich et al. | 333/125 |
| 6,297,714 B1 | * | 10/2001 | Hirtzlin et al. | 333/135 |

OTHER PUBLICATIONS

Merriam–Webster's Collegiate Dictionary, 2000, 10$^{th}$ edition, 2 pages.*

* cited by examiner

*Primary Examiner*—Robert Pascal
*Assistant Examiner*—Dean Takaoka
(74) *Attorney, Agent, or Firm*—William J. Burke

(57) ABSTRACT

A device for efficient propagation of radio frequency (RF) signals, including concurrent transmission of signals of different polarizations, includes a waveguide having an input port for receiving electromagnetic radiation having a first polarized signal and a second polarized signal, the first and second polarized signals being orthogonal to one another. The waveguide includes first and second substrates mounted therein and positioned transverse to the longitudinal axis thereof. Both the first and second substrates are substantially transmissive of the electromagnetic radiation. The first substrate includes a probe formed thereon for transmitting or receiving the first polarized signal, and the second substrate includes a probe for transmitting or receiving a second polarized signal. A grid substrate is mounted in the waveguide between the first and second substrates and positioned transverse to the longitudinal axis thereof. The grid substrates includes a multiplicity of metallic lines disposed in a spaced apart relation and oriented to be reflective of the first polarized signal and transmissive of the second polarized signal.

20 Claims, 4 Drawing Sheets

102

102

504

DEVICE FOR PROPAGATING RADIO FREQUENCY SIGNALS IN PLANAR CIRCUITS

CROSS-REFERENCE TO RELATED APPLICATIONS

This application claims benefit of U.S. provisional patent application serial No. 60/267,690, filed Feb. 9, 2001, which is herein incorporated by reference.

BACKGROUND OF THE INVENTION

1. Field of the Invention

The present invention generally relates to radio frequency propagation devices and, more particularly, to a waveguide device for propagating radio frequency signals in planar circuits, including the concurrent transmission of signals of different polarizations.

2. Description of the Related Art

In general, compact electronic systems are made up of functional modules, such as local oscillator, signal processing, power, and/or control modules. Such functional modules are typically mounted on different layers of a single multi-layer circuit to provide compact systems. Mounting functional modules on different layers within a circuit, however, requires the use of multi-layer interconnects. For low frequencies, different layers can be connected using vias or coaxial lines. For microwave and millimeter-wave frequencies, different layers are presently connected using actual connectors, such as subminiature type A (SMA) connectors. The use of such connectors, however, increases the system cost and limits design flexibility.

In addition, some electronic systems, particularly electronic communication systems, provide for concurrent transmission of signals of different polarizations and/or different frequencies through a common channel in order to use the frequency spectrum efficiently. Thus, a transmitter circuit would use one polarization while a receiver circuit would use another. If the transmitter and receiver circuits are on different layers in a multi-layer circuit, an orthomode transducer (OMT) is required to connect the layers to a common input/output. An OMT typically connects the transmitter and receiver circuits through interconnects that employ actual connectors or waveguide flanges. Such connections result in bulky metal structures that are not convenient for integration into compact multi-level electronic circuits.

Therefore, there exists a need in the art for a device for efficient propagation of radio frequency (RF) signals, including concurrent transmission of signals of different polarizations, in planar circuits.

SUMMARY OF THE INVENTION

The present invention generally provides a device for efficient propagation of RF signals, including concurrent transmission of signals of different polarizations, in planar circuits. In one embodiment, an orthomode transducer comprises a waveguide having an input port for receiving electromagnetic radiation having a first polarized signal and a second polarized signal, the first and second polarized signals being orthogonal to one another. The waveguide includes first and second substrates mounted therein and positioned transverse to the longitudinal axis thereof. Both the first and second substrates are substantially transmissive of the electromagnetic radiation. The first substrate includes a probe formed thereon for transmitting or receiving the first polarized signal, and the second substrate includes a probe for transmitting or receiving a second polarized signal. The probe on the first substrate is oriented parallel to the polarization vector of the first polarized signal, and the probe on the second substrate is oriented parallel to the polarization vector of the second polarization vector. A grid substrate is mounted in the waveguide between the first and second substrates and positioned transverse to the longitudinal axis thereof. The grid substrates includes a multiplicity of metallic lines disposed in a spaced apart relation and oriented to be reflective of the first polarized signal and transmissive of the second polarized signal.

In a second embodiment, an apparatus for interconnecting a plurality of planar circuits comprises a waveguide for propagating electromagnetic radiation, a first substrate, and at least one additional substrate. The first and additional substrates are mounted within the waveguide and are positioned traverse to the longitudinal axis thereof. The first and additional substrates are substantially transmissive of the electromagnetic radiation. The first substrate includes a probe formed thereon for transmitting the electromagnetic radiation. The additional substrates include probes formed thereon oriented in the same direction as the probe on the first substrate for receiving the electromagnetic radiation transmitted therefrom.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention is a device for efficient propagation of radio frequency (RF) signals, including concurrent transmission of signals of different polarizations, in planar circuits. In one embodiment, the present invention is an orthomode transducer that integrates directly with microwave planar circuits, such as those commonly found in satellite communications systems. In a second embodiment, the present invention is a propagation device for interconnecting layers in a multi-layer planar circuit, such as those employed in satellite communications systems. In the second embodiment, the present invention again integrates directly with the planar circuits, obviating the need for external connectors or vias between the multi-layer microwave circuits. Although the embodiments of the present invention are described with specific reference to satellite communication systems, those skilled in the art will appreciate that the embodiments of the present invention have applications in microwave systems that require devices for RF propagation in general.

Figure 1:
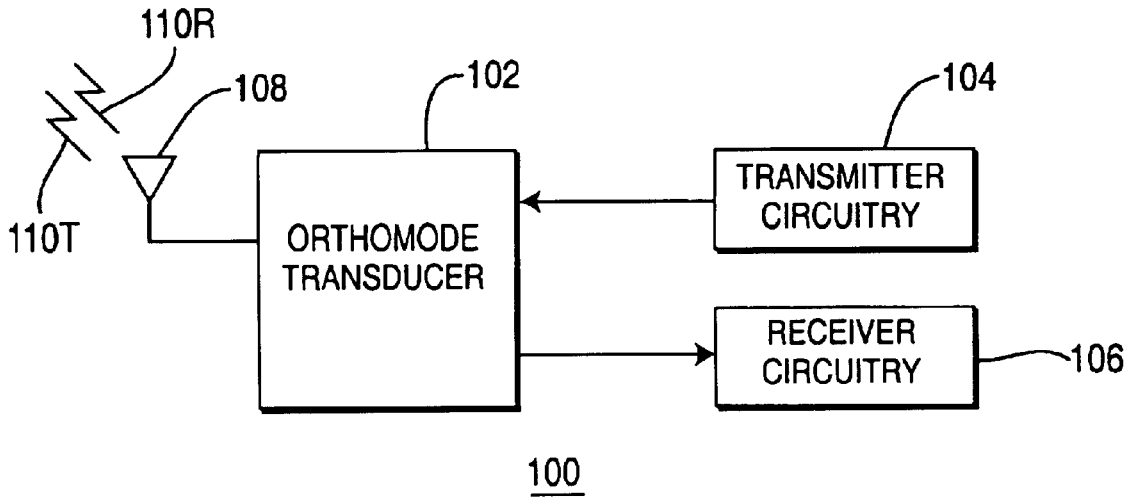
FIG. 1 depicts a block diagram showing an exemplary transceiver incorporating one embodiment of the RF propagation device of the present invention.

FIG. 1 depicts a block diagram showing an exemplary transceiver 100 incorporating one embodiment of the present invention. Specifically, the transceiver 100 comprises an antenna 108, an orthomode transducer 102, transmitter circuitry 104, and receiver circuitry 106. The transceiver 100 receives signals 110R having a first polarization via antenna 108 and couples the signals 110 to the receiver circuitry 106. In addition, the transceiver 100 transmits signals 110T having a second polarization via the antenna 108. Signals 110T are produced by the transmitter circuitry 104. The transceiver 100 allows for efficient use of the frequency spectrum by having the transmitter circuitry 104 transmit signals 110T having one polarization (e.g., vertical or right-hand circular polarization) and the receiver circuitry 106 receive signals 110R that have another polarization that is orthogonal to the first polarization (e.g., horizontal or left-hand circular). That is, signals 110R and 110T can be concurrently received and transmitted by the antenna 108 of the transceiver 100 without interfering with each other. Signals 110R and 110T can be of the same frequency, or can be of different frequencies.

The orthomode transducer 102 provides the interface between the transmitter circuitry 104 and the receiver circuitry 106, and the antenna 108. Specifically, the orthomode transducer 102 carries signals 110R from the antenna 108 to the receiver circuitry 106, and carries signals 110T from the transmitter circuitry to the antenna 108. Because signals 110R and 110T share a common interface with the antenna 108, the orthomode transducer must be capable of separating the signals 110R from signals 110T. As described more fully below with respect to FIG. 2, the orthomode transducer 102 of the present invention is capable of separating signals 110R and 110T from each other with minimal insertion loss and maximal isolation between the two polarizations.

The transmitter and receiver circuitry 104 and 106 typically comprise microwave planar circuits. In particular, the transmitter and receiver circuitry 104 and 106 can each comprise a separate layer in a multi-layer planar circuit. In accordance with the present invention, the orthomode transducer 102 integrates directly with the transmitter and receiver planar circuits 104 and 106, avoiding the need to use actual connectors or waveguide flanges for connecting the orthomode transducer 102 to the transmitter and receiver circuitry 104 and 106. The integration of the orthomode transducer 102 and the planar circuits advantageously saves a significant amount of space in, for example, satellite communications systems, where real estate is at a premium. Although the orthomode transducer 102 of the present invention is described with specific reference to satellite communication systems, those skilled in the art will appreciate that the orthomode transducer of the present invention is useful for dual polarized communication systems in general. In addition, the present invention is described in relation to dual linear polarized radiation and for use with millimeter-wave and microwave frequency devices. Those skilled in the art, however, will readily understand the dimensions required to use the teaching of the disclosure at other frequencies.

Figure 2:
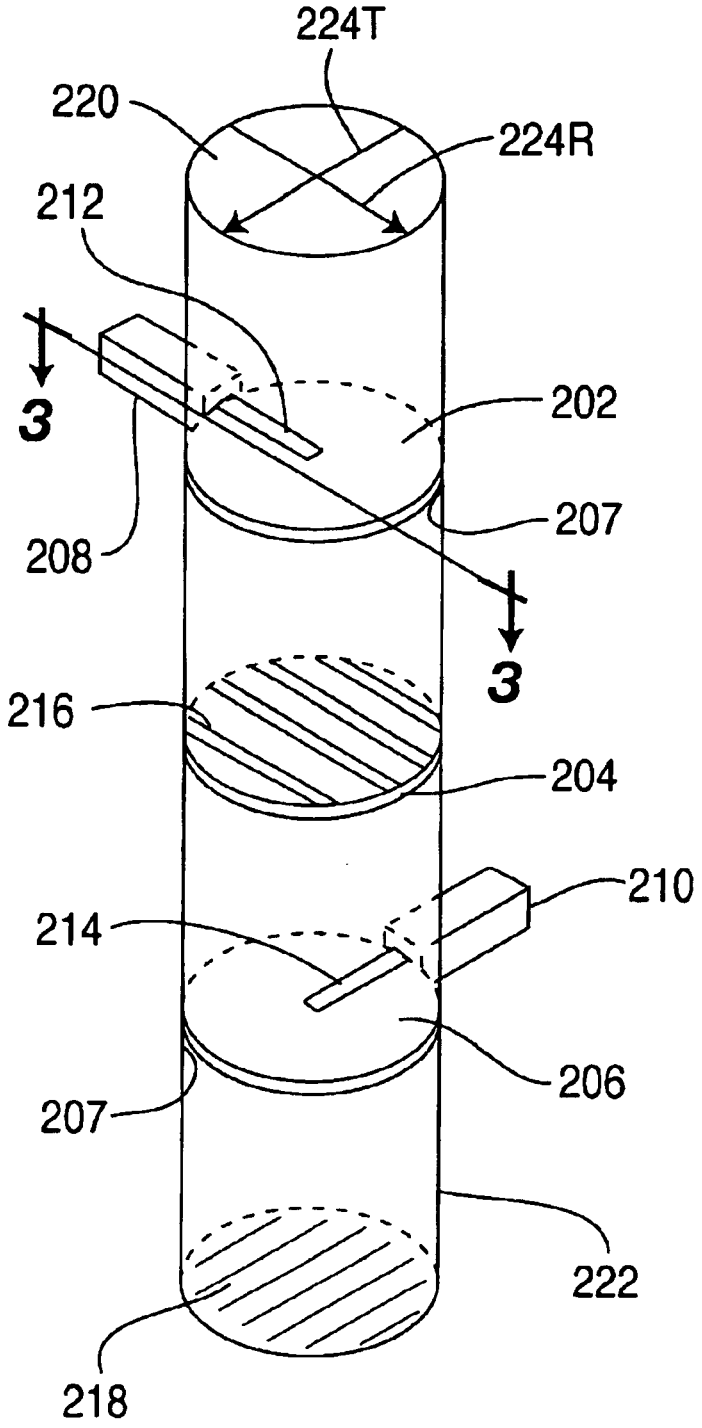
FIG. 2 illustrates a perspective view of the RF propagation device of FIG. 1.

FIG. 2 illustrates a perspective view of the orthomode transducer 102 of the present invention. The orthomode transducer 102 comprises a waveguide 222 having an input port 220, a first substrate 202, a grid substrate 204, a second substrate 206, and a cap 218. In the embodiment shown, the waveguide 222 has a generally circular cross-section. Alternatively, the waveguide 222 can have a generally square cross-section. The cross-section of the waveguide 222 must be selected so as to be capable of propagating two orthogonally polarized signals. The waveguide 222 includes a conductive interior surface for propagating electromagnetic radiation. This is accomplished by either forming the waveguide 222 from metallic materials or by coating the interior surface of the waveguide 222 with a suitably conductive material. The waveguide 222 also includes a flange with bolt holes (not shown) for securing the antenna 108 to the waveguide 222 at the input port 220. The input port 220 concurrently propagates electromagnetic radiation comprising the signals 110R and 110T, each having different polarizations as described above. As shown in FIG. 2, signals 110R and 110T are depicted by their polarization vectors 224R and 224T, respectively, which are shown orthogonal to each other.

The first substrate 202, the second substrate 206, and the grid substrate 204 are mounted within the waveguide 222 and are positioned substantially transverse to the longitudinal axis thereof. The substrates 202, 204, and 206 are secured in place using a variety of techniques including mounting brackets and/or bonding compounds. A groove, lip, or ridge 207 can also be formed in the interior surface of the waveguide 222 for supporting each substrate 202, 204, and 206 therein. The specific mounting technique used depends on the design constraints imposed by the specific application (mechanical stress, space, cost, period of use) as will be apparent to those skilled in the art. With any method of mounting, adequate care must be taken to ensure the continuity of the currents along the walls of the waveguide 222.

The substrates 202, 204, and 206 comprise a material substantially transmissive of electromagnetic radiation at the operation frequencies, such as, for example, 20 GHz. Such materials include quartz, plastic, glass, or like type microwave and millimeter wave substrates known in the art that are highly transmissive of the wavelength of radiation of interest. It will be recognized by those skilled in the art, however, that other materials are suitable for the substrates 202, 204, and 206 depending on the frequency of operation chosen for the waveguide 222. Any material inserted into the waveguide 222 will impact the attenuation of the waveguide 222 and care must be taken to use as minimum dimension for the thickness of the substrates 202, 204, and 206 as possible. For frequencies on the order of 20 GHz, for example, a quartz substrate should be on the order of 3.8 millimeters or less (i.e., ½ of the wavelength of the signal or less). Thicker substrates can be used for other applications depending on allowable insertion losses. Thinner substrates (e.g., 0.1 millimeters or less) can also be used, which would be independent of operating frequency.

Each of the first and second substrates 202 and 206 includes a probe 212 and 214, respectively, formed thereon for receiving electromagnetic radiation. The probes 212 and 214 comprise microstrip lines of a length appropriate for the frequency of operation (e.g., ⅔ of a quarter wavelength). Although the substrates 202 and 206 support microstrip probes 212 and 214, the portions of the substrates 202 and 206 that are disposed in the cross-section of the waveguide 222 do not include a groundplane, since a groundplane would interfere with the transmission of electromagnetic radiation in the waveguide 222. As shown, the probe 212 is oriented on the first substrate 202 parallel to the polarization vector 224R and orthogonal to the polarization vector 224T. Thus, the probe 212 is capable of receiving electromagnetic radiation having the polarization 224R, which is parallel to the direction of the length of the probe 212. Signals having the polarization 224T pass through the probe 212. On the other hand, probe 214 is oriented on the second substrate 206 parallel to the polarization vector 224T and orthogonal to the polarization vector 224R. Thus, the probe 214 is capable of receiving electromagnetic radiation having the polarization 224T, and passing signals having the polarization vector 224R (as described more fully below, however, signals having the polarization vector 224R do not pass the grid substrate 204).

The grid substrate 204 includes a multiplicity of metallic lines 216 formed thereon in a spaced apart relation. The grid substrate 204 acts as a back-short for the first substrate 202 and acts as a filter for the second substrate 206. That is, the metallic lines 216 are oriented parallel to the polarization vector 224R, thus reflecting the electromagnetic radiation having the polarization vector 224R and passing the electromagnetic radiation having a polarization vector 224T. The position of the grid substrate 204 relative to the first substrate 202 varies from ¼ to ⅙ the guided wavelength (the position varies because the probe 212 introduces some reactance). Thus, at millimeter-wave frequencies, this distance is on the order of 10 mm or less. The electromagnetic radiation having the polarization vector 224T is then received by the probe 214 on the second substrate 206. The cap 218 provides the back short for the second substrate 206. Again, the second substrate 206 is places from ¼ to ⅙ the guided wavelength from the cap 218. Although the present invention has been described as receiving signals of different polarizations, those skilled in the art understand that the description applies to the transmission of signals as well.

The number of metallic lines 216 and the spacing therebetween control the isolation between the polarizations 224R and 224T. The higher the number of gridlines and the closer the spacing, the higher the isolation. In one embodiment, at least ten metallic lines 216 are used per wavelength at the highest frequency of operation. The metallic lines 216 can be formed as a thin metal sheet on a layer of substrate material. Again, adequate care must be taken to ensure the continuity of currents along the interior surface of the waveguide 222. The metallic lines 216 contact the walls in order to create a short for reflecting the electromagnetic radiation having the polarization vector 224R.

Figure 3:
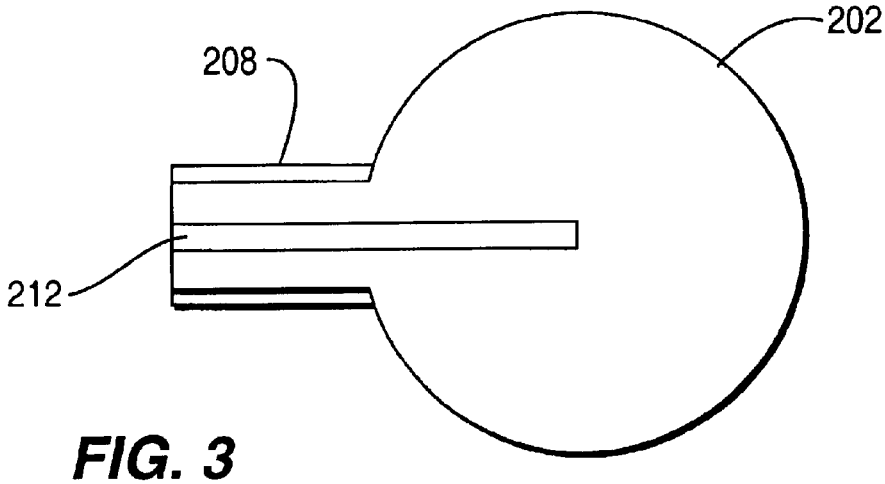
FIG. 3 is a cross-sectional view of the RF propagation device of FIG. 1 taken along the section line 3—3.

FIG. 3 shows a cross-sectional view of the orthomode transducer 102 taken along the section line 3—3. Referring simultaneously to FIGS. 2 and 3, the substrates 202 and 206 can extend beyond the waveguide 222 via dog-channels 208 and 210, respectively. As shown, the first substrate 202 and the probe 212 both extend into the dog-channel 208. This allows the probes 212 and 214 to be coupled to circuits external to the waveguide 222. For example, as described above, the probe 212 is oriented to receive signals having the polarization 224R, which in the present embodiment are signals 110R used by the receiver circuitry 106. Thus, the probe 212 can be further coupled to the receiver circuitry 106. On the other hand, the probe 214 is oriented to transmit signals having the polarization 224T, which in the present embodiment are signals 110T used by the transmitter circuitry. Thus, the probe 214 can be further coupled to the transmitter circuitry 104. In the manner, the orthomode transducer 102 of the present invention can be directly integrated with planar circuits, such as transmitter and receiver circuits, obviating the need for external connectors or waveguide flanges. This allows the orthomode transducer 102 of the present invention to be used in compact communication systems where space is at a premium.

Figure 4:
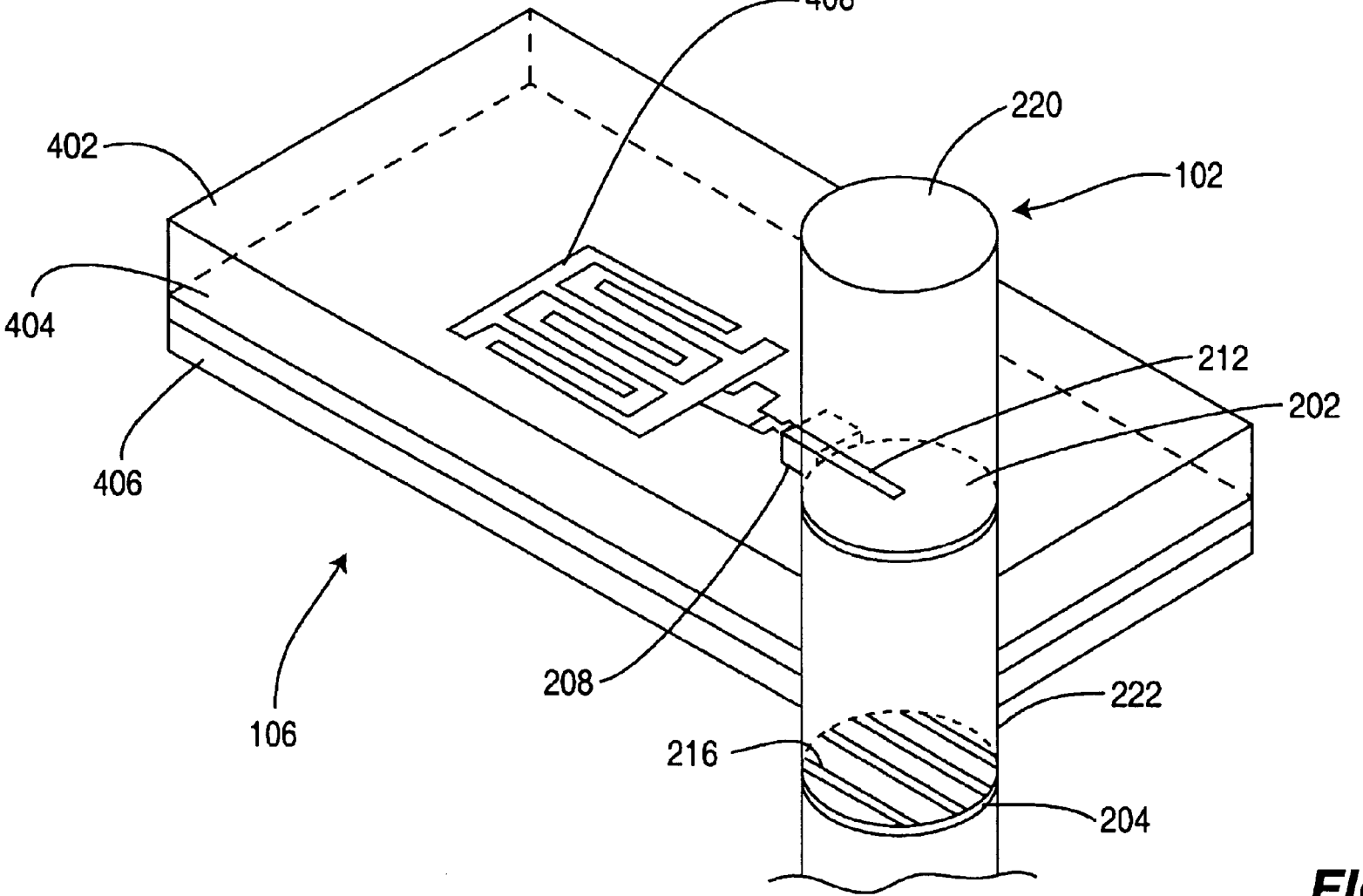
FIG. 4 illustrates a perspective view of portions of the transceiver and the RF propagation device of FIG. 1.

Specifically, FIG. 4 illustrates a perspective view of portions of the transceiver 100 and the orthomode transducer 102 of the present invention. Only the receiver circuitry 106 is shown for simplicity. In this exemplary embodiment, the receiver circuitry 106 comprises a substrate 404 enclosed within, and spaced apart from, a metal shielded case 402. The substrate 404 includes a microstrip receiver circuit 408 and a metal groundplane 406. The substrate 404 is formed so as to allow the orthomode transducer 102 to pass therethrough in order to interface with the microstrip circuit 408. That is, the waveguide 222 passes through the substrate 404 such that the first substrate 202 (i.e., the substrate receiving signals with the polarization 224R) is substantially in line with the substrate 404. In this manner, the probe 212 can be coupled with the microstrip circuit 408 in order to electrically couple the signals 110R having the polarization vector 224R thereto. As will be apparent to those skilled in the art, the orthomode transducer 102 of the present invention can be coupled to the transmitter circuitry 104 in substantially the same manner. The transmitter circuitry 104 can be a separate circuit or part of a multi-layer circuit with the receiver circuitry 106, as is typically the case. The orthomode transducer 102 of the present invention advantageously provides a compact RF propagation solution for multi-layer transceiver circuits that are used in, for example, satellite communication systems.

Figure 5:
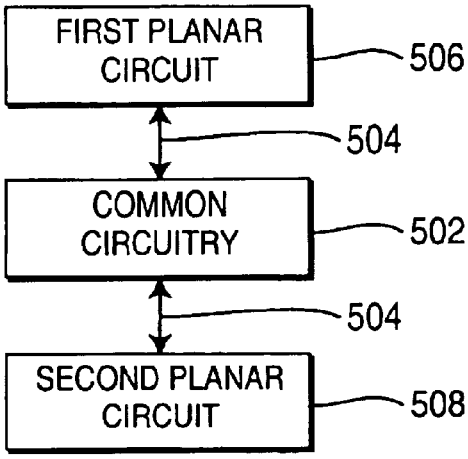
FIG. 5 depicts a block diagram showing an exemplary multi-layer planar circuit incorporating a second embodiment of the RF propagation device of the present invention.

FIG. 5 depicts a block diagram showing an exemplary multi-layer planar circuit 500 incorporating a second embodiment of the present invention. The multi-layer planar circuit 500 comprises a first planar circuit 506, a second planar circuit 508, common circuitry 502, and a multi-layer interconnect device 504. The circuits 506 and 508, and the common circuitry 502 are on different layers of a multi-layer planar circuit. As described above, this type of circuit is commonly used in satellite communication systems. In such applications, the transmitter and receiver circuits will reside on different layers of the multi-layer circuit, and both the transmitter and receiver circuits will make use of common circuitry located on yet another layer. The common circuitry typically comprises modules such as a local oscillator, an up/down converter, a signal processor, and power and control circuits. All of these modules may reside on one or more layers and need to be made available to both the transmitter and receiver circuits. In accordance with the present invention, the multi-layer interconnect device 504 connects the common circuitry 502 with both the first and second planar circuits 506 and 508 without the use of external connectors, vias, and/or coaxial lines. As noted above, at higher microwave and millimeter-wave frequencies, vias and the like exhibit reactive impedances that have an adverse effect on performance. Also, external connectors, such as SMA connectors, increase the system cost as well as limit the flexibility of design. Thus, the multi-layer interconnect device 504 provides for a cost effective, simple, and efficient connection device for multi-layer circuits that operate at microwave and millimeter-wave frequencies.

Figure 6:
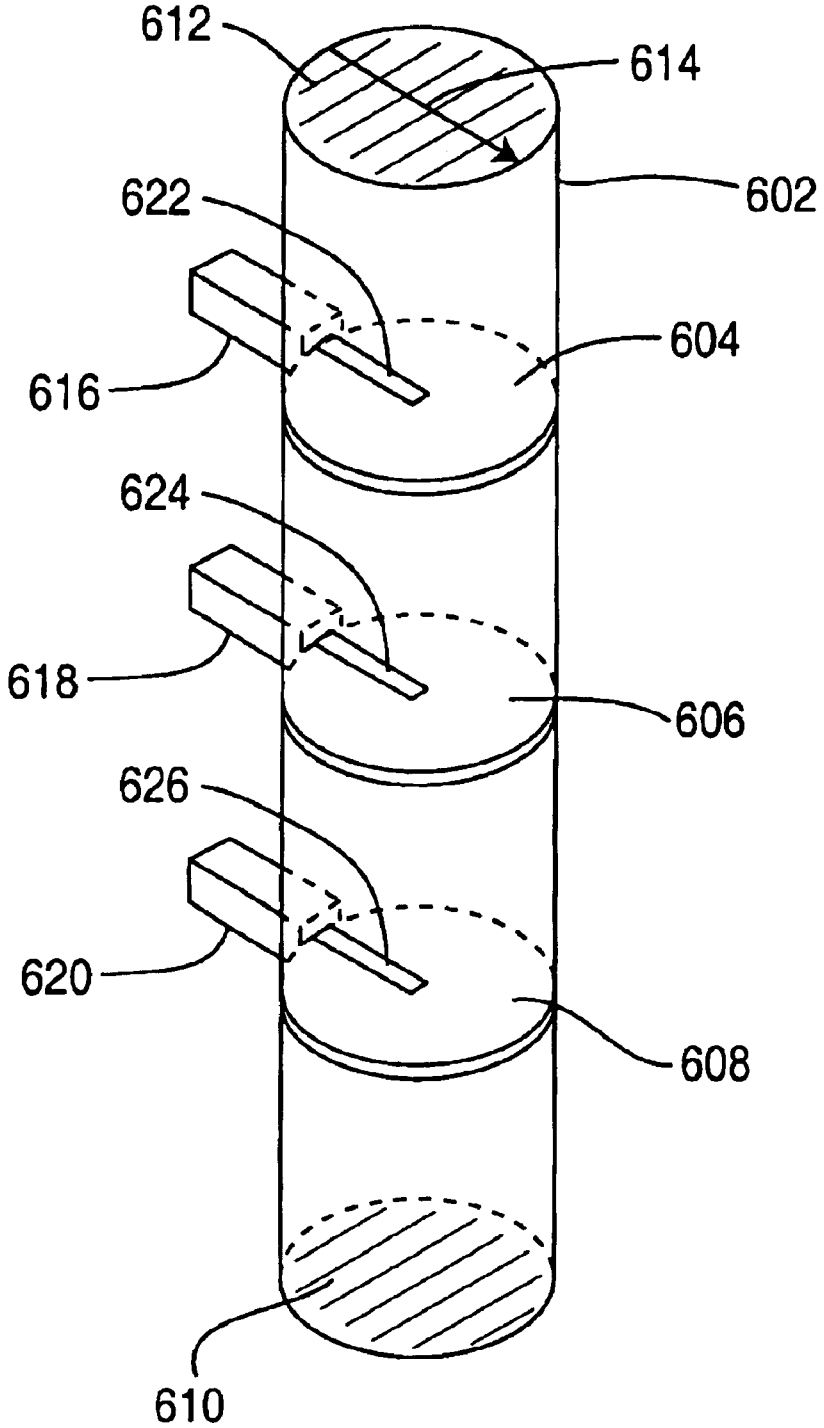
FIG. 6 illustrates a perspective view of the RF propagation device of FIG. 5.

Specifically, FIG. 6 shows an exemplary multi-layer interconnect device 504 in accordance with the present invention. The multi-layer interconnect device 504 comprises a waveguide 602 formed substantially as described above with respect to the orthomode transducer 102. Substrates 604, 606, and 608 are mounted within the waveguide 602 and are positioned substantially traverse to the longitudinal axis thereof. Each substrate 604, 606, and 608 includes a probe 622, 624, and 626, respectively. In addition, each substrate 604, 606, and 608 can extend beyond the waveguide 602 via dog-channels 616, 618, and 620, respectively.

In operation, the waveguide 602 distributes electromagnetic radiation having a polarization vector 614. Probes 622, 624, and 626 are microstrip lines that are oriented in the same direction, that is, the direction parallel to the polarization vector 614. Thus, each probe 622, 624, and 626 can transmit or receive electromagnetic radiation that is propagating within the waveguide 602. For example, if the common circuitry 502 is coupled to the probe 624 in a manner similar to that described with respect to FIG. 4, then the common circuitry could transmit electromagnetic radiation to probes 622 and 626. Probes 622 and 626 could be connected to the first planar circuit 506 and the second planar circuit 508, respectively. Caps 610 and 612 are employed to provide back shorts for the substrates 608 and 604, respectively. In this manner, signals from the common circuitry can be provided to both planar circuits 506 and 508.

While foregoing is directed to the preferred embodiment of the present invention, other and further embodiments of the invention may be devised without departing from the basic scope thereof, and the scope thereof is determined by the claims that follow.

What is claimed is:

1. A radio frequency (RE) propagation device comprising:

a waveguide for receiving electromagnetic radiation, the waveguide having a longitudinal axis;

a first substrate mounted within the waveguide and positioned transverse to the longitudinal axis thereof, the first substrate being substantially transmissive of the electromagnetic radiation and having a first probe formed thereon for transmitting or receiving at least a portion of the electromagnetic radiation;

a second substrate mounted within the waveguide and positioned transverse to the longitudinal axis thereof, the second substrate being substantially transmissive of the electromagnetic radiation and having a probe formed thereon for transmitting or receiving at least a portion of the electromagnetic radiation.

2. The device of claim 1 wherein the electromagnetic radiation comprises a first polarized signal and a second polarized signal and the apparatus further comprises a grid substrate mounted within the waveguide and positioned transverse to the longitudinal axis thereof between the first and second substrates, the grid substrate having a multiplicity of metallic lines disposed in a spaced apart relation and oriented to be reflective of the first polarized signal and transmissive of the second polarized signal.

3. The device of claim 1 further comprising at least one additional substrate mounted within the waveguide and positioned transverse to the longitudinal axis thereof, the at least one additional substrate being substantially transmissive of the electromagnetic radiation and having a probe formed thereon for transmitting or receiving at least a portion of the electromagnetic radiation.

4. The device of claim 1 wherein the waveguide further comprises:

a first dog-channel proximate the first substrate for providing an output for the first probe; and a second dog-channel proximate the second substrate for providing an output for the respective probe formed thereon.

5. The device of claim 1 wherein the first probe and the second probe have a length approximately two-thirds of the wavelength of the electromagnetic radiation.

6. The device of claim 1 wherein at least one of the first and second substrates comprise a material selected from the group of quartz, plastic, and glass.

7. The device of claim 1 wherein at least one of the first and second substrates is mounted within the waveguide via a groove, lip, or ridge formed within an interior surface of the waveguide.

8. The device of claim 1 wherein at least one of the first and second substrates is mounted within the waveguide via bonding compounds.

9. An radio frequency (RE) propagation device comprising:

a waveguide having a longitudinal axis and a first port for receiving electromagnetic radiation comprising a first polarized signal and a second polarized signal;

a first substrate mounted within the waveguide and positioned transverse to the longitudinal axis thereof, the first substrate being substantially transmissive of the electromagnetic radiation and having a first probe formed thereon, the first probe being oriented on the first substrate to transmit or receive the first polarized signal;

a second substrate mounted within the waveguide and positioned transverse to the longitudinal axis thereof, the second substrate being substantially transmissive of the electromagnetic radiation and having a second probe formed thereon, the second probe being oriented on the second substrate to transmit or receive the second polarized signal; and a grid substrate mounted within the waveguide and positioned transverse to the longitudinal axis thereof between the first and second substrates, the grid substrate having a multiplicity of metallic lines disposed in a spaced apart relation and oriented to be reflective of the first polarized signal and transmissive of the second polarized signal.

10. The device of claim 9 wherein the waveguide further comprises:

a first dog-channel proximate the first substrate for providing an output for the first probe; and a second dog-channel proximate the second substrate for providing an output for the second probe.

11. The device of claim 9 wherein the first probe and the second probe have a length approximately two-thirds of the wavelength of the first and second polarized signals.

12. The device of claim 9 wherein the grid substrate is disposed one-quarter to one-sixth of the wavelength of the first and second polarized signals from the first substrate.

13. The device of claim 9 wherein at least one of the first, second, and grid substrates comprise a material selected from the group of quartz, plastic, and glass.

14. The device of claim 9 wherein at least one of the first, second, and grid substrates is mounted within the waveguide via a groove, lip, or ridge formed within an interior surface of the waveguide.

15. The device of claim 9 wherein at least one of the first, second, and grid substrates is mounted within the waveguide via bonding compounds.

16. The device of claim 9 wherein the grid substrate includes ten metallic lines per wavelength of the first and second polarized signals.

17. An apparatus for interconnecting a plurality of planar circuits comprising:

a waveguide for propagating electromagnetic radiation, the waveguide having a longitudinal axis;

a first substrate mounted within the waveguide and positioned transverse to the longitudinal axis thereof, the first substrate being substantially transmissive of the electromagnetic radiation and having a first probe formed thereon for transmitting the electromagnetic radiation;

at least one additional substrate mounted within the waveguide and positioned transverse to the longitudinal axis thereof, the at least one additional substrate being substantially transmissive of the electromagnetic radiation and having a probe formed thereon for receiving the electromagnetic radiation.

18. The apparatus of claim 17 wherein the waveguide further comprises:

a first dog-channel proximate the first substrate for providing an output for the first probe; and at least one additional dog-channel proximate a respective at least one additional substrate for providing an output for the respective probe formed thereon.

19. The apparatus of claim 17 wherein the first probe and the at least one additional probe have a length approximately two-thirds of the wavelength of the electromagnetic radiation.

20. The apparatus of claim 17 wherein at least one of the first and additional substrates is mounted within the waveguide via a groove, lip, or ridge formed within an interior surface of the waveguide.

* * * * *